US007540587B2

(12) United States Patent
Kobayashi et al.

(10) Patent No.: US 7,540,587 B2
(45) Date of Patent: Jun. 2, 2009

(54) LIQUID PASSAGE FORMING MEMBER GUIDING DEVICE

(75) Inventors: Atsushi Kobayashi, Nagano-ken (JP); Shinya Yamagata, Nagano-ken (JP); Kiyoshi Mukaiyama, Nagano-ken (JP); Steven Chen, Taipei (TW)

(73) Assignee: Seiko Epson Corporation, Tokyo (JP)

( * ) Notice: Subject to any disclaimer, the term of this patent is extended or adjusted under 35 U.S.C. 154(b) by 478 days.

(21) Appl. No.: 11/411,746

(22) Filed: Apr. 26, 2006

(65) Prior Publication Data

US 2006/0284945 A1 Dec. 21, 2006

(30) Foreign Application Priority Data

Apr. 28, 2005 (JP) ..... 2005-133445

(51) Int. Cl.
*B41J 23/00* (2006.01)

(52) U.S. Cl. ..... 347/37; 347/84; 347/85

(58) Field of Classification Search ..... 347/84–86, 347/37

See application file for complete search history.

(56) References Cited

U.S. PATENT DOCUMENTS

| | | | |
|---|---|---|---|
| 5,043,746 | A | 8/1991 | Abe |
| 6,188,417 | B1 | 2/2001 | Keefe et al. |
| 2004/0021746 | A1 | 2/2004 | Sole et al. |

FOREIGN PATENT DOCUMENTS

| | | | |
|---|---|---|---|
| CN | 2573231 | Y | 9/2003 |
| DE | 101 05 352 | C1 | 8/2002 |
| JP | 2003-320680 | A | 11/2003 |
| JP | 2004-262092 | A | 9/2004 |
| JP | 2005-035033 | A | 2/2005 |
| TW | M245063 | U | 10/2004 |
| WO | 2005/011984 | A1 | 2/2005 |

OTHER PUBLICATIONS

Office Action in European patent appln. No. 06008872.1 (Mar. 6, 2008).

English language explanation of relevance of cited reference CN 2573231.

*Primary Examiner*—Lamson D Nguyen

(74) *Attorney, Agent, or Firm*—Stroock & Stroock & Lavan LLP

(57) ABSTRACT

A guiding device guides, in a main body of a liquid ejection apparatus, a flexible passage forming member having a passage therein in a predetermined routing direction while curving the passage forming member. The guiding device includes a holding member. The holding member is engaged with a curved section of the passage forming member, and holds the curved section in an undeformable manner in the apparatus main body. The holding member guides the passage forming member in the routing direction. Thus, the guiding device is capable of efficiently routing passage forming members while bending the members in a body of a liquid ejection apparatus.

8 Claims, 2 Drawing Sheets

LIQUID PASSAGE FORMING MEMBER GUIDING DEVICE

CROSS-REFERENCE TO RELATED APPLICATIONS

This application is based upon and claims the benefit of priority from prior Japanese Patent Application No. 2005-133445, filed on Apr. 28, 2005, the entire contents of which are incorporated herein by reference.

BACKGROUND OF THE INVENTION

The present invention relates to a device for guiding a liquid passage forming member.

Inkjet printers are widely known as liquid ejection apparatuses for ejecting liquid onto a target. Such a printer has a recording head mounted on a reciprocating carriage. Ink (liquid) is supplied to the recording head from ink cartridges (liquid containers). The recording head has nozzles, through which ink is ejected onto a recording medium, or a target, thereby subjecting the recording medium printing. Such printers include, for example, a printer disclosed in Japanese Laid-Open Patent Publication No. 2004-262092, in which ink cartridges are mounted on a carriage (on-carriage type) and a printer disclosed in Japanese Laid-Open Patent Publication No. 2003-320680, in which ink cartridges are not mounted on a carriage but fixed to a fixing position of the printer (off-carriage type).

An ink cartridge of an on-carriage type printer has a small ink capacity due to a limited space on the carriage. Thus, when performing a large amount of printing, ink cartridges need to be frequently replaced. Therefore, when performing a large amount of printing, not only replacement of ink cartridges needs to be performed manually, but also, the running costs are increased. Accordingly, some on-carriage type printers have been modified such that an external high capacity ink tank is connected to the ink cartridges on the carriage. When such a modification is applied, ink supply tubes (liquid passage forming members) for supplying ink from the external ink tank to the ink cartridges are routed inside the printer while being curved at several locations.

However, in an on-carriage type printer, ink cartridges are primarily attached to the carriage, and there is no need to route ink supply tubes. Therefore, partly due to demands for size reduction of printers, hardly any space exists between a frame 11 of a printer 10 and a rear surface 16*d* of a carriage 16 as shown in FIG. 1B. Even if ink supply tubes extending from an external ink tank are routed along a front surface 16*a* of the carriage 16, the tubes need to be curved toward an upper surface of the ink cartridges. A sufficient space for permitting the tubes to be curved cannot be easily created. Particularly, a recent increase in the types of ink colors has resulted in an increased number of ink supply tubes in a printer. This increases the size of a space for permitting the ink supply tubes to be curved.

SUMMARY

Accordingly, it is an objective of the present invention to provide a guiding device for passage forming members, the device being capable of efficiently routing passage forming members while bending the members in a body of a liquid ejection apparatus.

According to a first aspect of the invention, a guiding device is provided. The guiding device guides, in a main body of a liquid ejection apparatus, a flexible passage forming member having a passage therein in a predetermined routing direction while curving the passage forming member. The guiding device includes a holding member. The holding member is engaged with a curved section of the passage forming member, and holds the curved section in an undeformable manner in the apparatus main body. The holding member guides the passage forming member in the routing direction.

According to a second aspect of the invention, a guiding device that guides, in a main body of a liquid ejection apparatus, a plurality of flexible passage forming members each having a passage therein in a predetermined routing direction while curving the passage forming members is provided. The liquid ejection apparatus includes a carriage that reciprocates in the apparatus main body. The carriage has a front surface parallel to the reciprocation direction, an upper surface parallel to the reciprocation direction, and a side surface perpendicular to the reciprocation direction. The guiding device fixes the passage forming members, which are arranged in parallel on the front surface along the reciprocation direction, to the side surface in a curved state on the side surface, and guides the passage forming members in parallel along the upper surface.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

An on-carriage type printer according to one embodiment of the present invention will now be described with reference to FIGS. 1A to 3.

Figure 1A:
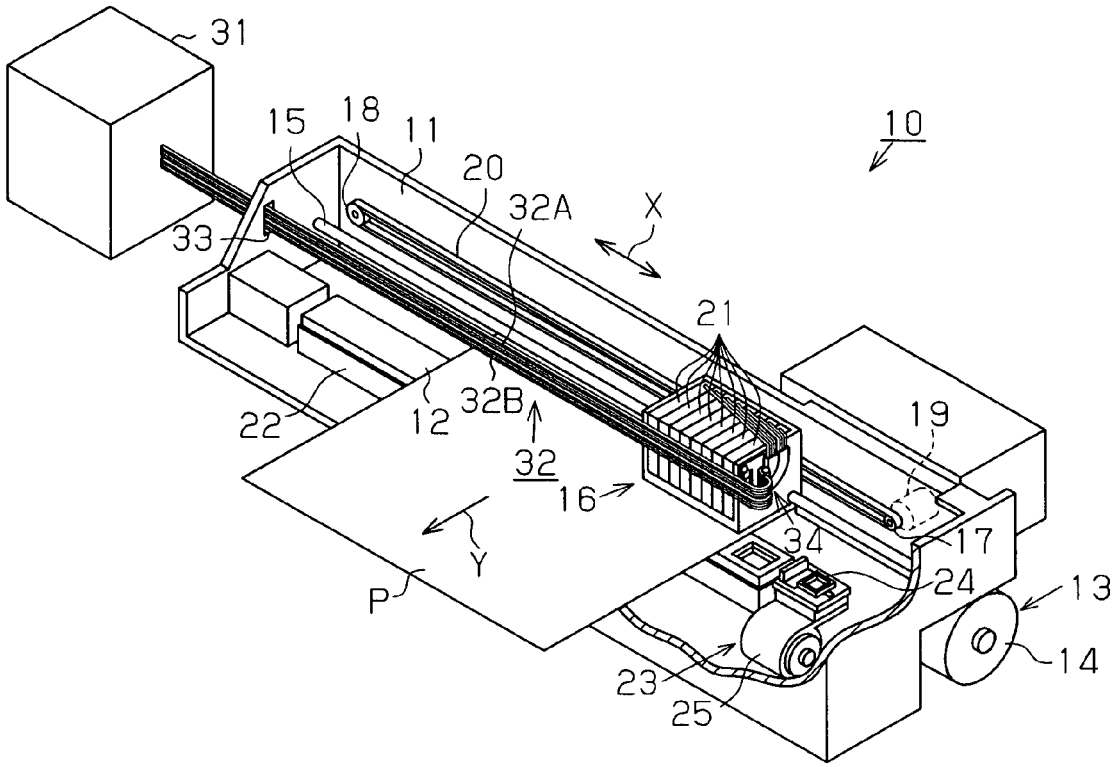
FIG. 1A is a perspective view, with a part cut away, illustrating a printer according to one embodiment of the present invention.

As shown in FIG. 1A, a liquid ejection apparatus, which is a printer 10, includes a box-shaped apparatus main body, which is a frame 11. A platen 12 is provided in a lower portion of the frame 11. The platen 12 extends along the longitudinal direction of the frame 11 (main scanning direction X shown in FIG. 1). The platen 12 is support supporting a target, which is a sheet of paper P. Based on a driving force of a paper feeder motor of a paper handling mechanism 13, the platen 12 feeds the sheet of paper P along a sub-scanning direction Y perpendicular to the main scanning direction X. Hereinafter, a front-rear direction, a left-right direction, and an up-down direction are defined with respect to the sub-scanning direction Y (direction in which the sheet of paper P is fed) defined as a frontward direction.

In the frame 11, a guide rod 15 extending along the platen 12 is provided above the platen 12. The guide rod 15 extends through and movably supports a carriage 16. On the inner surface of the frame 11, a drive pulley 17 and a driven pulley 18 are rotatably supported in positions corresponding to both ends of the guide rod 15. The drive pulley 17 is connected to a carriage motor 19. A timing belt 20, to which the carriage 16 is fixed, is engaged with the drive pulley 17 and the driven pulley 18. Therefore, while being guided by the guide rod 15, the carriage 16 is moved along the main scanning direction X by the carriage motor 19 with the timing belt 20. The carriage 16 includes a first surface, which is a right side surface 16*b* intersecting the reciprocation direction (direction X) of the carriage 16, a second surface, which is an upper surface 16*c* extending along the reciprocation direction, and a third surface, which is a front surface 16*a* extending along the reciprocation direction.

A recording head (not shown), which functions as a liquid ejection head, is mounted in a lower portion of the carriage 16. Nozzles (not shown) are provided in the lower surface of the recording head. Ink cartridges 21, which function as liquid containers, are detachably attached to the carriage 16 above the recording head. The number of the ink cartridges 21 is eight in this embodiment. The ink cartridges 21 are supplied with liquid, or ink (eight types of ink, which are dark and light types of magenta, cyan, yellow, and magenta) a high capacity ink tank 31 through a tube bundle 32 for supplying ink shown in FIG. 1A. Then, when piezoelectric elements (not shown) provided in the recording head are activated, ink is supplied to the ink cartridges 21, and ejected through the nozzles onto the sheet of paper P fed onto the platen 12. In this manner, printing is performed onto the sheet of paper P.

Also, as shown in FIG. 1A, a liquid waste tank 22 extending parallel to the platen 12 is located in the frame 11 below the platen 12. An absorbing member (not shown) that is made of, for example, porous pulp material, is accommodated in the liquid waste tank 22. A cleaning mechanism 23 is located in an end portion of the printer 10 (right end portion as viewed in FIG. 1A), or in a non-ejection area by which the sheet of paper P does not pass. The cleaning mechanism 23 draws ink remaining in the nozzles to prevent the nozzles from being clogged. The cleaning mechanism 23 has a cap 24 for sealing the recording head and a suction pump 25 functioning as a suction portion.

As shown in FIG. 1A, the high capacity ink tank 31, functioning as a liquid retaining member, is located outside of the frame 11 of the printer 10 (on the left of the frame 11). The high capacity ink tank 31 accommodates eight high capacity ink packs (not shown) that retain ink of eight colors corresponding to the eight ink cartridges 21 on the carriage 16. The high capacity ink tank 31 is connected to the ink cartridges 21 with the tube bundle 32 functioning as a passage forming member.

The tube bundle 32 is made of a flexible material such as polyethylene. The tube bundle 32 is drawn into the frame 11 through an insertion hole 33 formed in the frame 11. The tube bundle 32 is routed to the carriage 16 (the ink cartridges 21) by a tube guiding device 34, which functions as a passage forming member guiding device. That is, the upstream end of the tube bundle 32 is connected to the high capacity ink tank 31, while the downstream end of the tube bundle 32 is connected to the ink cartridges 21 on the carriage 16. Since the tube guiding device 34 for guiding the tube bundle 32 is a main feature of the present invention, the structure, as well as the manner in which the tube bundle 32 is routed in the frame 11, will be described below.

Figure 2:
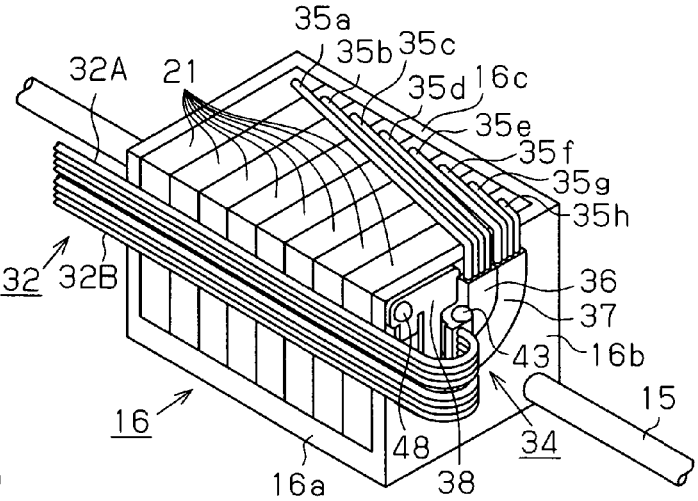
FIG. 2 is a perspective view illustrating the carriage and its surroundings shown FIG. 1A.

Ink passages 35 (see FIG. 3), the number of which corresponds to the number of the ink packs in the high capacity ink tank 31, are defined in the tube bundle 32. In this embodiment, the number of the ink passages 35 is eight. That is, the tube bundle 32 has tube members 35*a*, 35*b*, 35*c*, 35*d*, 35*e*, 35*f*, 35*g*, 35*h*, the number of which is eight in this embodiment. Each of the tube members 35*a*, 35*b*, 35*c*, 35*d*, 35*e*, 35*f*, 35*g*, and 35*h* has a downstream end connected to the corresponding ink cartridge 21 as shown in FIG. 2. The tube members 35*a*-35*h* are formed as two integrated belts each having a predetermined number (four in this embodiment) of the tube members 35*a*-35*h*. Specifically, the tube bundle 32 includes a first tube bundle 32A of four of the tube members, or the tube members 35*a*, 35*b*, 35*c*, 35*d* integrated to form a belt, and a second tube bundle 32B of the remaining four of the tube members, or the tube members 35*e*, 35*f*, 35*g*, 35*h* integrated to form a belt (see FIG. 3).

The upstream end of each of the tube members 35*a*-35*h* communicates with the corresponding ink pack in the high capacity ink tank 31. The downstream end of each of the tube members 35*a*-35*h* is connected to the corresponding ink cartridge 21 on the carriage 16 as shown in FIG. 2. Therefore, ink in the high capacity ink tank 31 flows into the ink cartridges 21 through the ink passages 35 in the tube bundle 32, and is then supplied to the nozzles of the recording head (neither is shown) on the carriage 16.

Next, the manner in which the tube bundle 32 is routed in the frame 11 and the tube guiding device 34 for guiding the tube bundle 32 to the ink cartridges 21 on the carriage 16 will be described.

Figure 3:
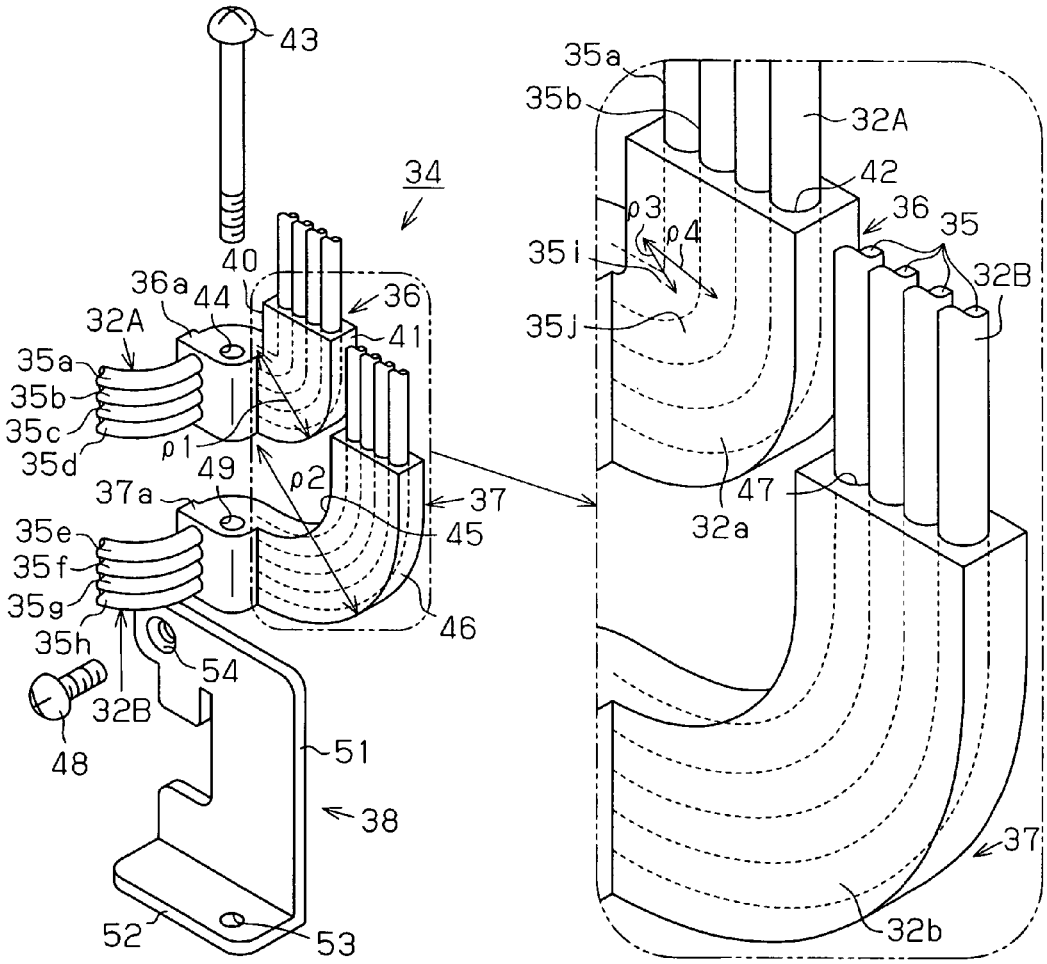
FIG. 3 is an exploded perspective view illustrating a tube guiding device shown in FIG. 2.

As shown in FIG. 3, the tube guiding device 34 includes a first holding member 36, a second holding member 37, and an attachment member 38. The tube guiding device 34 is supported by and fixed to the carriage 16 with the attachment member 38, which integrates the first holding member 36 with the second holding member 37.

The first holding member 36 holds a first curved section 32*a* of the first tube bundle 32A at a right side surface 16*b* of the carriage 16. The first tube bundle 32A extends from the high capacity ink tank 31 through the insertion hole 33 of the frame 11 and along the front surface 16*a* of the carriage 16. The first tube bundle 32A is routed from the front surface 16*a* to the right side surface 16*b* of the carriage 16, and then curved upward 90° from the front-rear direction on the right side surface 16*b* so that the first tube bundle 32A is directed toward the upper surface 16*c* of the carriage 16. Subsequently, the first tube bundle 32A is bent toward the upper surface 16*c*. A section of the first tube bundle 32A curved 90° on the right side surface 16*b* forms the first curved section 32*a*. The first holding member 36 holds the first curved section 32*a*in an undeformable manner relative to the carriage 16 (such that the curved state is maintained). In this manner, the first tube bundle 32A is routed by the first holding member 36. The first holding member 36 is formed as a hollow block, and includes a first inner edge surface 40 curved to form a quarter circle, and a first outer edge surface 41 curved at a radius of curvature greater than that of the first inner edge surface 40.

Also, an insertion passage 42 is formed to extend through the first holding member 36. The insertion passage 42 is curved to conform to the first inner edge surface 40 and the first outer edge surface 41. The cross-section of the insertion passage 42 is the same as the cross-sectional outline of the first tube bundle 32A. When the first tube bundle 32A is inserted into the insertion passage 42, the first curved section 32*a*is engaged with and held by the inner surface of the insertion passage 42 so that the curved state of the section 32*a*cannot be changed. A vertical hole 44 is formed in and extends through a proximal end (the lower end as viewed in FIG. 3) 36*a* of the first holding member 36. When the first holding member 36 is integrated with the second holding member 37, a first screw 43 is inserted into the hole 44.

When routing the second tube bundle 32B from the front surface 16*a* of the carriage 16 to the right side surface 16*b*, and then causing the second tube bundle 32B to extend from the right side surface 16*b* toward the upper surface 16*c*, the second holding member 37 holds a second curved section 32*b* in an undeformable manner in the frame 11 (that is, such that the curved state is maintained). The second holding member 37 is formed as a hollow block, and includes a second inner edge surface 45 curved to form a quarter circle as viewed from a side, and a second outer edge surface 46 curved at a radius of curvature greater than that of the second inner edge surface 45. The entire second holding member 37 is shaped as a hollow block curved by a radius of curvature greater than that of the first holding member 36. The second inner edge surface 45 is shaped to conform to the first outer edge surface 41 of the first holding member 36. When the first holding member 36 is vertically stacked with the second holding member 37, the first outer edge surface 41 of the first holding member 36 is engaged with the second inner edge surface 45 of the second holding member 37.

An insertion passage 47 is formed in the second holding member 37. The cross-sectional shape of the insertion passage 47 is the same the cross-sectional outline of the second tube bundle 32B. The insertion passage 47 is also formed to conform to the curvature of the second inner edge surface 45 and the second outer edge surface 46 of the second holding member 37. When the second tube bundle 32B is inserted into the insertion passage 47, the second curved section 32*b* is engaged with and held by the inner surface of the insertion passage 47 so that the curved state of the section 32*b* cannot be changed. A vertical hole 49 is formed in and extends through a proximal end (the lower end as viewed in FIG. 3) 37*a* of the second holding member 37. When the second holding member 37 is integrated with the first holding member 36, the first screw 43 is inserted into the hole 49.

The radius of curvature $\rho 1$ of the first outer edge surface 41 of the first holding member 36, which is located above the second holding member 37 as shown in FIG. 3 during assembly is less than the radius of curvature $\rho 2$ of the second outer edge surface 46 of the second holding member 37. The first and second holding members 36, 37 hold the first and second curved sections 32*a*, 32*b* such that the radii of curvature of the tube members 35*a* to 35*h* (ink passages 35) are different from one another. For example, the first holding member 36 holds the first curved section 32*a*such that the radii of curvature $\rho 3$, $\rho 4$ of the curved sections 35*i*, 35*j* of the tube members 35*a*, 35*b* satisfy the expression $\rho 3<\rho 4$.

The attachment member 38 is used for fixing the first holding member 36 and the second holding member 37 to the right side surface 16*b* of the carriage 16. The attachment member 38 is a substantially L-shaped thin plate, and includes a vertically extending attachment piece 51 and a support piece 52 extending in a horizontal direction from the lower end of the attachment piece 51. A threaded hole 53 is formed in the support piece 52. The first screw 43 is screwed to the threaded hole 53 to fix the first holding member 36 and the second holding member 37 to the attachment member 38. On the other hand, a threaded hole 54 is formed in the attachment piece 51. A second screw 48 is screwed to the threaded hole 54 to fix the attachment member 38 to the right side surface 16*b* of the carriage 16.

Next, operation of the printer 10 according to the present embodiment will be described while mainly focusing on the operation of the tube guiding device 34.

The tube bundle 32, the upstream end of which is connected to the high capacity ink tank 31, has a downstream end inserted into the printer 10 through the insertion hole 33 of the frame 11. In the printer 10, the tube bundle 32 is guided to extend in the moving direction (rightward as viewed in FIG. 1) of the carriage 16, or along the front surface 16*a* of the carriage 16 (parallel to the front surface 16*a* of the carriage 16). The downstream ends of the first tube bundle 32A and the second tube bundle 32B are inserted in to the insertion passages 42, 47 of the first and second holding members 36, 37. Then, as shown in FIG. 3, the first tube bundle 32A and the second tube bundle 32B are curved so that the first and second curved sections 32*a*, 32*b* are engaged with the inner surfaces of the first and second insertion passage 42, 47. The first and second curved sections 32*a*, 32*b* are thus held to be undeformable.

Then, the first holding member 36 and the second holding member 37 are stacked vertically such that the first outer edge surface 41 of the first holding member 36 contacts the second inner edge surface 45 of the second holding member 37, and the holes 44, 49 of the proximal ends 36*a*, 37*a* are aligned with the threaded hole 53 of the attachment member 38. In this state, the first screw 43 is inserted into the holes 44, 49 and screwed to the threaded hole 53 of the attachment member 38. This integrally assembles the first holding member 36 and the second holding member 37 with the attachment member 38.

Next, the attachment piece 51 of the attachment member 38 is brought into contact with the right side surface 16*b* of the carriage 16, and the second screw 48 is screwed to the threaded hole 54 of the attachment piece 51. This allows the tube guiding device 34 to be fixed to and supported by the right side surface 16*b* of the carriage 16. Thereafter, as shown in FIG. 2, the downstream end of each of the tube members 35*a* to 35*h* is connected to the ink cartridge 21 of the corresponding color. Accordingly, the routing of the tube bundle 32 through the front surface 16*a*, the right side surface 16*b*, and the upper surface 16*c* of the carriage 16 in order is completed.

According to the above described printer 10, when the carriage 16 reciprocates, a section of the tube bundle 32 that is upstream of the tube guiding device 34 (a section routed along the front surface 16*a* of the carriage 16) is flexed. In contrast, a section of the tube bundle 32 that is downstream of the tube guiding device 34, that is, a section of the tube bundle 32 that is located on the upper surface of the carriage 16 is not flexed relative to the carriage 16.

The above described embodiment provides the following advantages.

(1) The first and second curved sections 32*a*, 32*b* of the tube bundle 32 are held by the first and second holding members 36, 37 so as to be undeformable in the frame 11 of the printer 10. Therefore, when routing the tube bundle 32 in the frame 11 while bending the tube bundle 32, the routing is efficiently performed without requiring a large space.

(2) The first holding member 36 and the second holding member 37 hold the first and second curved sections 32*a*, 32*b* of the tube bundle 32, the orientations of which are likely to be unstable. Thus, when the carriage 16 reciprocates, the tube bundle 32 receives a reduced amount of unnecessary bending stress. This prevents the ink passage 35 from being narrowed by an excessive degree.

(3) The first and second holding members 36, 37 hold the first and second curved sections 32*a*, 32*b* such that the radii of curvature of curved sections of the tube members 35*a* to 35*h*, for example, the radii of curvature ρ3, ρ4 of the curved sections 35*i*, 35*j* are different from each other.

Generally, if the tube bundle 32 is routed in the frame 11 while bending the tube members 35*a* to 35*h* such that the radii of curvature are different, the first inner edge surface 40 and the first outer edge surface 41 of the first curved section 32*a*have different radii of curvature and thus different bending stress. Thus, the orientations of the first and second curved sections 32*a*, 32*b* tend to be unstable.

In contrast, the first and second holding members 36, 37 of this embodiment reliably hold the first and second curved sections 32*a*, 32*b* of the tube bundle 32 in an undeformable manner. Therefore, the tube bundle 32 is stably routed.

(4) The tube guiding device 34 includes the first holding member 36 and the second holding member 37. Therefore, the tube guiding device 34 holds the tube bundle 32 in a divided manner. That is, the tube guiding device 34 separately holds the first tube bundle 32A including the tube members 35*a* to 35*d* and the second tube bundle 32B including the tube members 35*e* to 35*h*.

For example, in a case where all the tube members 35*a* to 35*h* are held all together, the minimum value of the bending stress acting on the tube bundle 32 is the bending stress acting on the innermost tube member 35*a*, and the maximum value of the bending stress is the bending stress acting on the outermost tube member 35*h*.

In contrast, in this embodiment, all the tube members 35*a* to 35*h* hare divided into the first tube bundle 32A including the tube members 35*a* to 35*d* and the second tube bundle 32B including the tube members 35*e* to 35*h*, and each of the bundles 32A and 32B are separately held. The minimum value of the bending stress acting on the first tube bundle 32A is the bending stress acting on the tube member 35*a*, and the maximum value of the bending stress acting on the first tube bundle 32A is the bending stress acting on the tube member 35*d*. The minimum value of the bending stress acting on the second tube bundle 32B is the bending stress acting on the tube member 35*e*, and the maximum value of the bending stress acting on the second tube bundle 32B is the bending stress acting on the tube member 35*h*. That is, the difference of the bending stresses acting on the tube bundles is minimized in this embodiment.

Thus, even if a considerable number of the tube members 35*a* to 35*h* are used because of the number of the types of ink and are routed in parallel, the tube bundle 32 are prevented from being damaged at curved sections.

Figure 1B:
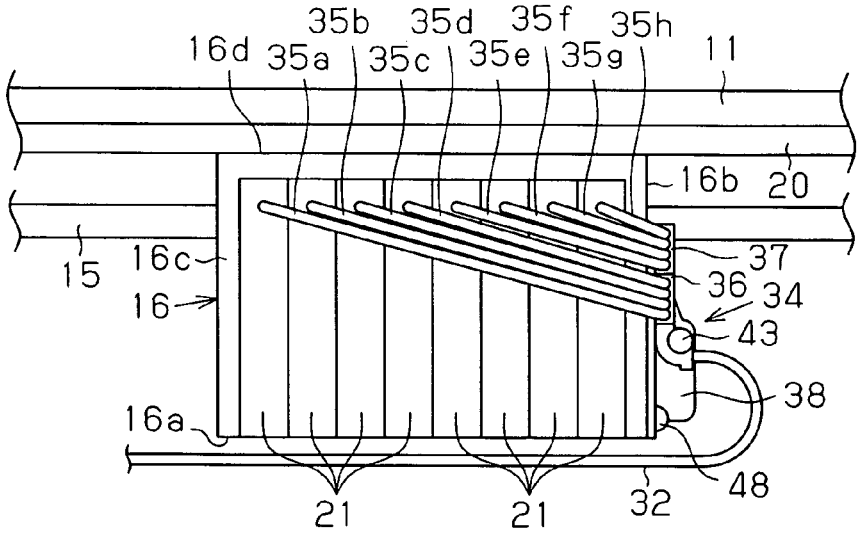
FIG. 1B is a plan view illustrating a carriage and its surroundings in the printer shown in FIG. 1A.

(5) The first holding member 36 and the second holding member 37 are supported by and fixed to the right side surface 16*b*, which is perpendicular to the moving direction of the carriage 16 (direction X in FIG. 1). Therefore, even if the space between the rear surface 16*d* of the carriage 16 and the frame 11 is small, the tube guiding device 34 is provided in a space facing the right side surface 16*b* of the carriage 16. Thus, the tube bundle 32 is stably routed while being curved.

(6) The tube guiding device 34 permits the tube bundle 32 to be held by the carriage 16. Therefore, the orientation of a section of the tube bundle 32 that is upstream of the tube guiding device 34, that is, the orientation of a section of the tube bundle 32 that extends along the front surface 16*a* of the carriage 16, is stabilized. In other words, the tube bundle 32 is smoothly flexed as the carriage 16 reciprocates.

Also, the orientation of a section of the tube bundle 32 that is downstream of the tube guiding device 34, that is, the orientation of a section of the tube bundle 32 that extends along the upper surface 16*c* of the carriage 16, is not flexed even if the carriage 16 reciprocates. Thus, unnecessary load is not applied to the joint between the downstream end of the tube bundle 32 and the ink cartridges 21. The connection between the tube bundle 32 and the ink cartridges 21 are stably maintained.

The above described embodiment may be changed as the following further embodiments (modified embodiments).

The tube guiding device 34 may guide ink supply tubes for supplying ink from an ink tank located in the frame 11 to the ink cartridges 21.

As long as a certain space is created adjacent to the rear surface 16*d* of the carriage 16 in the frame 11, the tube bundle 32 may routed to extend along the rear surface 16*d* of the carriage 16.

The tube bundle 32 of the above illustrated embodiment does not necessarily held on the right side surface 16*b* of the carriage 16, but may be held on the left side surface or the front surface of the carriage 16. Particularly, the configuration in which the tube bundle 32 is held on the left side surface of the carriage 16 is favorable when the size of a space facing the front surface 16*a* of the carriage 16 is insufficient for allowing the tube bundle 32 to be flexed. That is, the space facing the left side surface of the carriage 16 can be used for permitting the tube bundle 32 to be flexed.

The tube guiding device 34 may be supported in a position in the printer 10 other than the carriage 16.

The manner in which the first holding member 36 and the second holding member 37 hold the first and second tube bundles 32 A, 32B may be changed as necessary. For example, without providing the insertion passages 42, 47 in the first and second holding members 36, 37, the first and second holding members 36, 37 may be each divided into two sections along the thickness. The first and second curved sections 32*a*, 32*b* are held between the divided sections, so that the first and second tube bundles 32A, 32B are supported.

Also, without providing the insertion passages 42, 47 in the first and second holding members 36, 37, uneven sections that correspond to the first and second tube bundles 32A, 32B may be formed on the surfaces of the first and second holding members 36, 37 that face the right side surface 16*b* of the carriage 16. The first and second curved sections 32*a*, 32*b* are held between the uneven sections and the right side surface 16*b* of the carriage 16.

A section of the tube bundle 32 that is upstream of the tube guiding device 34, that is, a section of the tube bundle 32 that extends along the front surface 16*a* of the carriage 16 may be formed as a tube bundle separate from a section of the tube bundle 32 that is downstream of the tube guiding device 34, that is, a section of the tube bundle 32 that extends along the upper surface 16*c* of the carriage 16. In this case, the lower end of the downstream section of the tube bundle 32 and the upper end of the downstream section of the tube bundle 32 are connected to the first and second holding members 36, 37. In this case, ink is stably supplied from the high capacity ink tank 31 to the ink cartridges 21 through the upstream section of the tube bundle 32, the first and second holding members 36, 37, and the downstream section of the tube bundle 32.

The first holding member 36 and the second holding member 37 may be separately supported by the carriage 16.

In the above illustrated embodiment, the present invention is applied to an on-carriage type inkjet printer, in which the ink cartridges 21 are mounted on the carriage 16. The present invention is not limited to this, but may be applied to an off-carriage type inkjet printer. That is, the tube guiding device 34 is suitable for routing the flexible tube bundle 32 in a limited space while efficiently bending the bundle 32 either in an on-carriage type inkjet printer or an off-carriage type inkjet printer.

In the above embodiments, the present invention is applied to the printer 10, which ejects ink. However, the present invention may be applied to other types of liquid ejection apparatuses. For example, the present invention may be applied to printing machines including fax machines and copy machines, a liquid ejection apparatus for ejecting liquid such as electrode material or color material used for manufacturing electroluminescent displays and surface light emitting displays. The present invention may also be applied to liquid ejecting apparatus for ejecting biological organic matter used for manufacturing biochips. Alternatively, the present invention may be applied to sample ejecting apparatus such as a precision pipette. Also, the present invention may be applied to devices that use liquid other than ink.

Although the multiple embodiments have been described herein, it will be clear to those skilled in the art that the present invention may be embodied in different specific forms without departing from the spirit of the invention. The invention is not to be limited to the details given herein, but may be modified within the scope and equivalence of the appended claims.

The invention claimed is:

1. A guiding device that guides, in a main body of a liquid ejection apparatus having a carriage that reciprocates in a direction of reciprocation along a left-right direction relative to the main body, the carriage having an upper surface, a flexible passage forming member having a passage therein in a predetermined routing direction while curving the passage forming member, comprising:

a holding member, the holding member being engaged with a curved section of the passage forming member, and holding the curved section in an undeformable manner in the apparatus main body, wherein the holding member guides the passage forming member in the routing direction, wherein the holding member, when installed, is supported by the carriage, and wherein the holding member curves the passage forming member upward from a front-rear direction so that the passage forming member, when installed, is directed toward the upper surface of the carriage.

2. The guiding device according to claim 1, wherein the carriage includes a side surface that intersects the direction of reciprocation of the carriage, and wherein the holding member is provided on the side surface, and the passage forming member is bent from the side surface toward the upper surface.

3. The guiding device according to claim 2, wherein the side surface is perpendicular to the direction of reciprocation of the carriage.

4. The guiding device according to claim 2, wherein the carriage further includes a front surface, and the guiding device guides the passage forming member on the front surface along the direction of reciprocation, and the passage forming member is bent from the front surface to the side surface.

5. The guiding device according to claim 1, wherein the passage is one of a plurality of passages that are formed in the passage forming member and extend in parallel, and wherein the passage forming member is curved such that the passages have different radii of curvature at the curved section.

6. The guiding device according to claim 5, wherein the passage forming member includes a first passage forming member and a second passage forming member, the first passage forming member having at least one passage therein, and the second passage forming member being formed separately from the first passage forming member and having at least one passage therein, wherein the curved section includes a first curved section of the first passage forming member and a second curved section of the second passage forming member, and wherein the holding member includes a first holding member holding the first curved section and a second holding member holding the second curved section.

7. The guiding device according to claim 1, wherein one end of the passage forming member is connected to a liquid retaining member located outside of the apparatus main body, and wherein another end of the passage forming member is connected to a liquid container located on the carriage.

8. A guiding device that guides, in a main body of a liquid ejection apparatus, a plurality of flexible passage forming members each having a passage therein in a predetermined routing direction while curving the passage forming members, wherein the liquid ejection apparatus includes a carriage that reciprocates in the apparatus main body and reciprocates in a direction of reciprocation along a left-right direction relative to the main body, wherein the carriage has a front surface parallel to the reciprocation direction, an upper surface parallel to the reciprocation direction, and a side surface perpendicular to the reciprocation direction, wherein the guiding device fixes the passage forming members, which are arranged in parallel on the front surface along the reciprocation direction, to the side surface in a curved state on the side surface, so the passage forming member is curved upward from a front-rear direction, and guides the passage forming members in parallel along the upper surface.

* * * * *